US005328417A

United States Patent [19]

Cline et al.

[11] Patent Number: 5,328,417

[45] Date of Patent: Jul. 12, 1994

[54] CAST DISK AND METHOD OF MANUFACTURING THE SAME

[75] Inventors: Roger T. Cline; George B. Day, Jr., both of Maysville; Wilford R. Shaw, Tollesboro, all of Ky.

[73] Assignee: Emerson Electric Co., St. Louis, Mo.

[21] Appl. No.: 92,247

[22] Filed: Jul. 14, 1993

Related U.S. Application Data

[62] Division of Ser. No. 873,775, Apr. 27, 1992, Pat. No. 5,251,682.

[51] Int. Cl.[5] ..... F16H 7/00

[52] U.S. Cl. ..... 474/179

[58] Field of Search ..... 474/174, 179, 187, 195

[56] References Cited

U.S. PATENT DOCUMENTS 1,722,124 7/1929 Adey et al. .
1,774,660 9/1930 Nelson ..... 474/195 X
2,634,469 4/1953 Pershing et al. .
3,401,026 9/1968 Walker et al. .
3,545,524 12/1970 Beetle .
3,954,017 5/1976 Musgrove ..... 474/179
4,144,755 3/1979 Palloch ..... 474/174
4,196,640 4/1980 Rydberg ..... 474/174 X
5,224,642 7/1993 Davis et al. ..... 474/179 X

*Primary Examiner*—Thuy M. Bui
*Attorney, Agent, or Firm*—Polster, Lieder, Woodruff & Lucchesi

[57] ABSTRACT

An improved cast power transmission disk and method of forming the same, the disk including a peripheral rim having at least one power transmission unit spaced from a hub with an integral body portion therebetween, a major portion of the rim and hub and the entirety of the body being formed on one side of a mold parting plane along with preselected areas of build-up, chamfering and draft angles and the remaining minor portion being formed on the opposite side of the mold parting plane.

11 Claims, 2 Drawing Sheets

CAST DISK AND METHOD OF MANUFACTURING THE SAME

This is a divisional of copending application Ser. No. 07/873,775, filed on Apr. 27, 1992 now U.S. Pat. No. 5,251,682.

BACKGROUND OF THE INVENTION

The present invention relates to a cast power transmission disk and to a method of manufacturing such a disk and more particularly to a novel cast disk including peripheral rim, body and hub portions, the rim portion having at least one power transmission unit and a unique molding method for forming such cast disk.

Various types of cast disks including peripheral rim, hub and body portions are known in the art, as are methods of manufacturing such disks. In fact, it is known to cast a power transmission disk with molds formed to provide major and minor portions of the disk and then to chuck the disk on both sides of the disk for major machine finishing operations on both cast disk sides. Such machine indexed finishing operations on both disk sides in the past has involved machining both the outer and inner diameters of the rim, the body portion extending between the rim and hub—particularly when such body portion was in the cast form of spiders or radial-type arms—and both the inner and outer diameters of the hub.

The present invention, recognizing the desirability of casting a power transmission disk with molds formed to provide major and minor portions of a disk, utilizes such a known principal in combination with novel casting and machining features and with novel method steps including chamfering of selected areas of the novel power transmission disk to reduce subsequent machine indexed finishing operations, the addition of materials at other specifically selected areas of the disk to enhance strength and at the same time reduce overall material demands for such selected areas, the casting of appropriate draft angles at appropriate selected areas of the disk to accommodate for ready mold release and machine chucking and finishing operations and to also minimize such machine finishing operations at the cast parting areas by minimizing sharp or stepped edges at such parting areas. In addition, the present invention provides a novel, strong, well balanced power transmission disk structure along with a method of manufacturing the same which is both economical in manufacture and assembly, and which reduces machine indexed finishing operations in most instances to one disk side to allow for only one concentric and square chucking operation with little or no balance operations required and in those other instances to minimize machine finishing operations on both disk sides, allowing for ready chucking of both disk sides, if and when required, with minimum machine finishing operations at least on one disk side.

Various other features of the present invention will become obvious to one skilled in the art upon reading the disclosure set forth herein.

BRIEF SUMMARY OF THE INVENTION

More particularly the present invention provides an improved cast power transmission disk including a peripheral rim shaped to provide at least one motion transmission unit therein, a centrally disposed shaft receiving hub and an intermediately disposed disk body integrally and radially positioned between the rim and the shaft receiving hub comprising; an integral power transmission disk formed from a pair of faced mold sections to include preselectively chamfered areas and preselectively material reinforced areas, the disk having a mold parting plane along one face of the integral disk body with the body and major disk portion of the integral hub and rim falling as a major disk portion on one side of the mold parting plane and the remaining minor portion of the hub and rim integral with the body falling as a minor disk portion on the opposite side of the parting plane; at least the major portion of the cast disk on the one side of the mold parting plane being sized and shaped to serve as a first chuckable portion so that the minor disk portion of the cast disk can be readily chucked and machine finished at preselected locations. In addition, the present invention provides a novel method of forming a cast power transmission disk including a spaced peripheral rim shaped to provide at least one motion transmission unit and a hub integrally joined by a radially extending body portion comprising: forming a first mold contoured to form a major portion of the disk including major portions of the peripheral rim and hub and the entirety of the radial extending body portion, the first mold including passageways to conduct fluid material to be cast to the first mold contoured major disk portion; forming a mating second mold contoured to form the remaining minor portion of the disk including the remaining minor portions of the rim and hub with a parting plane positioned to be coincident with the adjacent face of the entire body portion when the first and second molds are positioned in faced casting relation, the second mold including passageways to conduct fluid material to be cast to the second mold contoured positions; the molds being contoured to include preselectively chamfered areas and preselectively material reinforced areas; placing the first and second contoured molds in faced molding position; passing a fluid medium through the first and second mold passageways to cast the disk; readily separating the first and second molds along the parting plane and removing the disk; chucking at least the major portion of the cast disk formed in the first mold; and, machine finishing preselected ares of the minor portion of the cast disk formed in the second mold.

It is to be understood that various changes can be made by one skilled in the art in one or more of the several parts of the novel apparatus disclosed herein and in one or more of the several steps of the disclosed novel method without departing from the scope or spirit of the present invention. For example, the peripheral rim of the novel cast disk can include one or more sheave grooves or can include various gear teeth shapes known in the art.

BRIEF DESCRIPTION OF THE DRAWINGS

Referring to the drawings which disclose one advantageous embodiment of the present invention.

DETAILED DESCRIPTION OF THE DRAWINGS

Figure 1:
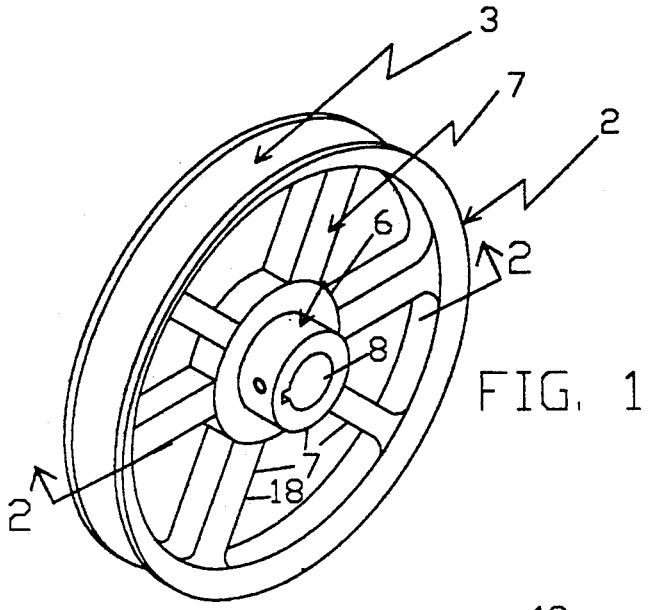
FIG. 1 is a perspective view of a cast power transmission disc incorporating features of the present invention and manufactured in accordance with the several novel method steps of the present invention.
Figure 2:
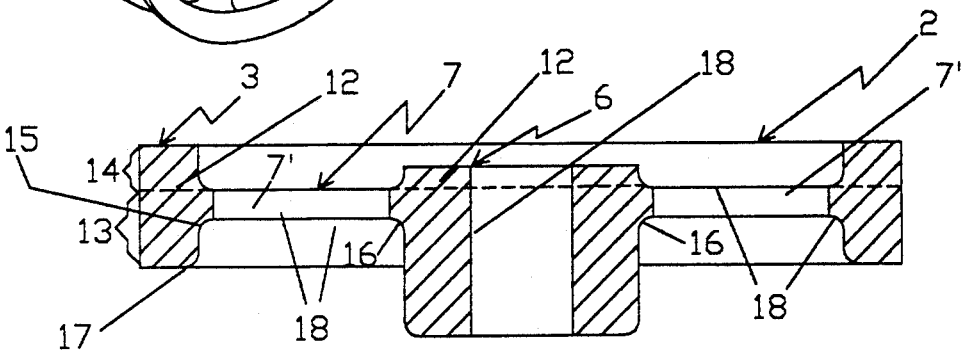
FIG. 2 is an enlarged cross-sectional view of the power transmission disc of FIG. 1 taken in a plane through line 2—2 of FIG. 1.

As can be seen in the drawings (FIGS. 1-3), the novel and unique improved cast power transmission disk 2 is disclosed as including a rim 3' formed or configured to include at least one motion transmission unit, configuratively machine finished in the form of one belt receiving sheave groove 4. In accordance with one feature of the present invention, disk 2 can be cast formed from a suitable molten metallic material such as a suitable cast metal of cast gray iron. It is to be understood that other types of metals and alloys of metals and even synthetic materials could be utilized in carrying out the present invention. Further, it is to be understood that the features of the present invention are not limited to include only one groove in the disk rim 3 but that several spaced grooves could be formed to provide a multi-grooved sheave and if desired, instead of a sheave formed groove or grooves, circumferentially spaced gear teeth, splines or other suitable power transmission mechanisms known in the power transmission art could be configuratively cast and/or machine formed along the rim—all in accordance with the inventive features as set forth herein.

The power transmission disk 2, in addition to rim 3, includes a centrally disposed shaft receiving hub 6 and an intermediate radially extending body portion 7. Body portion 7 as disclosed is in the form of integrally disposed radially extending spaced arms 7' which radially extend between rim 3 and shaft receiving hub 6, shaft receiving hub 6 being provided with an internally open-ended bore 8 which can be appropriately tapered and keyed to receive a bushing and power transmission shaft in tight fit therewith.

Figure 3:
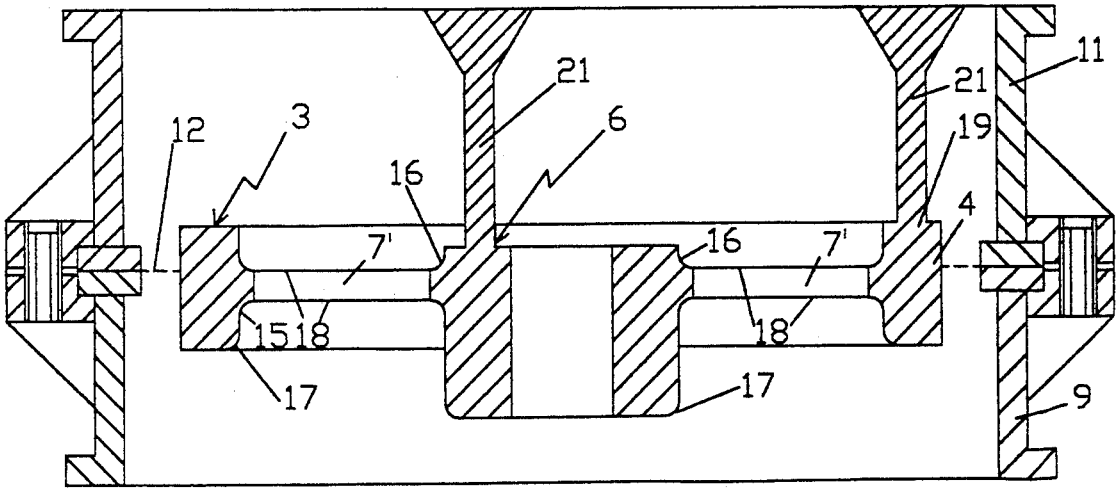
FIG. 3 is a cross-sectional view disclosing a cross-sectional view of a power transmission disc similar to that of FIG. 2, the disc being shown in a cross-section of a green sand casting mold contoured and utilized in accordance with the several steps of the novel method of the present invention; and, FIG. 4 is a schematic, partially cross-sectional, side view of a chucking operation in accordance with the present invention.

In accordance with the present invention and as can be seen in FIG. 3, integral power transmission disk 2 (here disclosed as cast for a single groove sheave) is formed from a pair of mating first and second mold sections, 9 and 11 respectively, FIG. 3 (described in detail hereinafter). These mating first and second mold sections 9 and 11 are provided with a mold parting plane 12, which advantageously is substantially flat, and is so disposed as to fall along one face of radially extending spaced arm 7' forming the radially extending body portion 7 so that the entirety of arms 7', and thus body portion 7 along with major portions of integral hub 6 and rim 3 of cast disk 2 fall on one side of mold parting plane 12 (in first mold section 9) to provide the major cast portion 13 of disk or sheave 2, with the remaining minor portion of hub 6 and grooved rim 3 constituting the minor cast portion 14 of disk or sheave 2 falling on the opposite side of parting plane 12. Not only does this structural arrangement assure ready and stable mechanical balancing of the major portion of sheave 2 but it allows such major portion 13 to readily serve as a first chuckable portion for appropriate machine finishing of minor portion 14 of disk or sheave 2 at preselected locations. It should be noted that, although in most instances, only a single machine index finishing is required on only the minor portion 14 of disk or sheave 2 with chucking and squaring of only major portion 13 to thus reduce operational time and expense, the minor portion 14 advantageously is sized to serve as a second chuckable portion for minimal machine indexing and finishing of already balanced major portion 13 of sheave 2. It also should be noted that in accordance with the structural features of the present invention, the radially extending spaced arm 7' of body 7 of the major cast portion 13 have added reinforcing material 16 at the base outer diameter 16 of hub 6 to increase the strength of hub 6 so as to allow reduced axial hub length. In addition, it further should be noted that chamfers 17 are formed along the internal diameter between rim 3 and the arms 7' both in the minor cast portion 14 and in the major cast portion 13 to minimize any sharp edges or offset steps and to provide maximum arm area for arm chucking operations. Moreover, it is to be noted that to further optimize disk 2 removal from casts 9 and 11 and to minimize machine finishing operations the edges of the radially extending ribs 7' are provided with minor draft angles as at 18. Finally, it is to be noted that at least the major cast portion 13 of rim 3 can be provided with a small reinforcing ring of cast material 15 adjacent the outer extremities of radial arms 7' Of body 7 to provide reinforcing strength during the chucking operations and to facilitate balance.

In accordance with the novel method of the present invention in forming the integral cast power transmission disk 2 including rim 3, radially extending body 7 comprised of spaced radially extending arm 7' and open-ended or bored hub 6, the first mold section 9 forming a major portion 13 of disk 2 is contour formed in a green sand casting process so that the major disk portion 13 includes major portions of the peripheral rim 3 and centrally open-ended, internally tapered hub 6 with the entirety of the radially extending body portion 7 being in the form of angularly spaced radially extending arms 7' extending from the major portion of central open-ended internally tapered hub 6 to the inner diameter of rim 3. This first mold section 9 includes the major portion of passageways 19 connected to spaced sprues 21 to conduct molten cast metal to be cast in said first mold section 9 as the contoured major disk portion 13. A mating second mold section 11 with the remaining minor portion of passageways 19 is contoured to form the remaining minor portion 14 of disk 2 also by a green-sand casting process. This minor disk portion 14 includes the remaining minor portions of rim 3 and hub 6 with mold parting plane 12 being between first and second mold sections 9 and 11 as a substantially flat plane coincident with the adjacent faces of the entirety of spaced radially extending arms 7' which constitute the entirety of the radially extending body portion 7 when first and second green sand mold sections 9 and 11 are positioned in faced molten iron receiving and casting relation. Like first mold section 9, the second mold section 11 includes the remainder of passageways 19 to conduct molten cast metal to be cast in the second mold section as contoured minor cast portion 14. It is to be noted that suitably spaced sprues 21 are connected to passageways 19 to introduce molten metal into the appropriate passageways.

As above described, mold section 9 and 11 are so contoured to provide added molten cast iron to form material reinforcement 16 at the base outer diameter of hub 6 to increase hub strength and allow a reduction of the axial length of hub 6. An optimum amount of molten cast iron also is furnished along the internal diameter of rim 3 to form minimum cast chamfer angles 17 with the internal diameter of rim 3 so as to provide a maximum area for chucking operations of the major cast portion 13. First mold section 9 and second mold sections 11 are so contoured along the outer periphery of the rim forming portion to allow for the machine indexing of at least one power transmission belt receiving groove 4 in peripheral rim 3. The first and second mold sections 9 and 11 are further contoured to provide draft release angles 18 along the outer edges of ribs 7.

Figure 4:
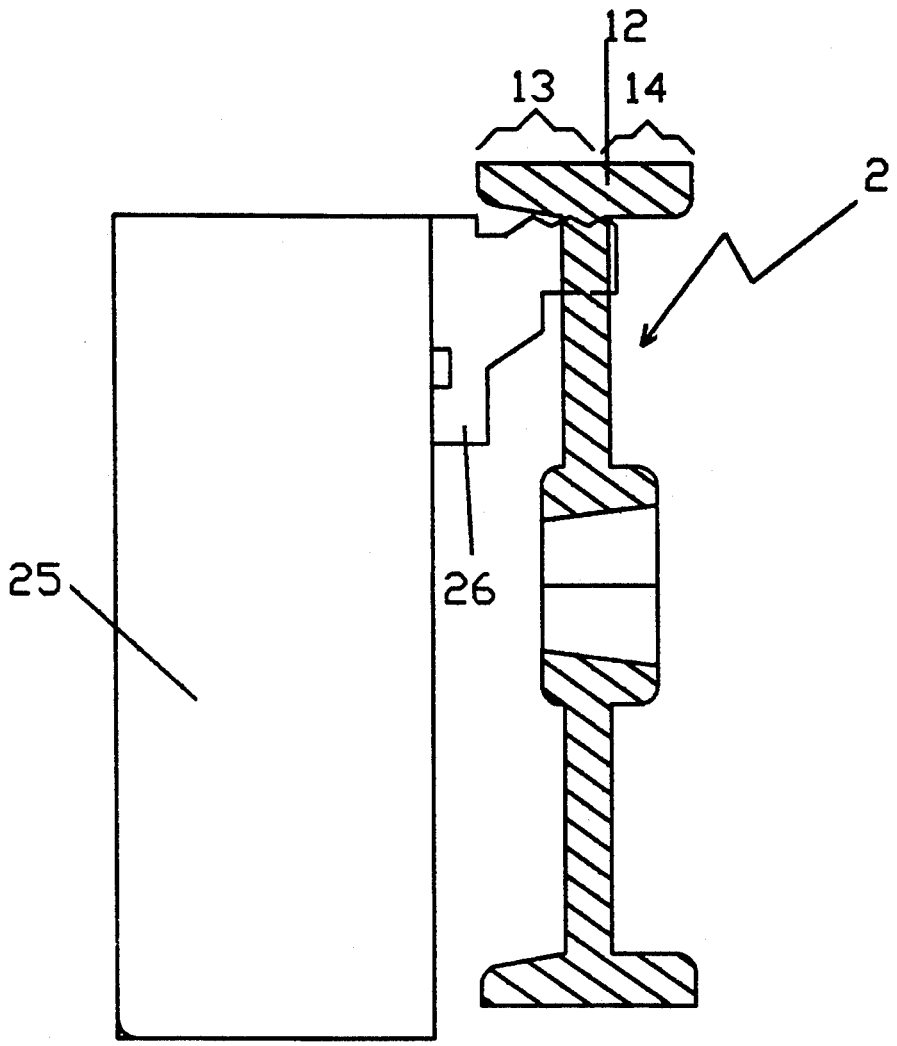

Once the green sand mold sections 9 and 11 are appropriately conformed and contoured as above described, they are placed in mated facing molding position along substantially flat parting plane 12 and molten material, advantageously cast gray iron is passed through sprues 21 to passageways 19 to cast form the disk 2. The mold sections 9 and 11 are then separated along parting plane 12 to remove the cast formed disk 2. The major cast portion 13 formed in the first green sand mold 9 is then squared and chucked to machine finish the minor portion 14 of disk 2 in a manner shown in FIG. 4 which schematically discloses a 3-jaw machine 25 with evenly spaced internal diameter chuck jaws 26 (only one jaw being shown in gripping relation with the major cast portion 13 of cast power transmission disk 2 with the cantilevered extremity of jaw 26 adjacent the parting line 12 to allow finishing of minor portion 14. The machine finished disk can then be grooved, drilled, tapped and key seated for adaptation to a split tapered bushing and drive or driven shaft. Thus, in accordance with the above described structure and method, a novel power transmission disk can be cast formed in a straight forwarded, economical manner, the disk being well balanced and requiring minimum chucking and machine finishing operations.

The invention claimed is:

1. An improved cast power transmission disk including a peripheral rim shaped to provide at least one motion transmission unit therein, a centrally disposed shaft receiving hub and an intermediately disposed disk body integrally and radially positioned between said rim and said shaft receiving hub comprising:

an integral power transmission disk formed from a pair of faced mold sections to include preselectively chamfered areas and preselectively material reinforced areas, said disk having a mold parting plane along one face of said integral disk body with said body and major portions of said integral hub and rim falling as a major disk portion on one side of said mold parting plane and the remaining minor portion of said hub and said rim integral with said body falling as a minor disk portion on the opposite side of said parting plane; at least said major portion of said cast disk on one side of said mold parting plane being sized and shaped to serve as a first chuckable portion so that said minor disk portion of said cast disk can be readily chucked and machine finished at preselected locations.

2. The improved cast power transmission disk of claim 1, said parting plane being substantially flat.

3. The improved cast power transmission disk of claim 1, said body portion of said disk comprising radially extending spaced arm members.

4. The improved cast power transmission disk of claim 3, said spaced arms having reinforcing material added at the base outer diameter of said hub to increase hub strength allowing reduction of axial hub length.

5. The improved cast power transmission disk of claim 3, said radially extending arm members forming minimum casting angles with the internal diameter of said rim to provide maximum arm area for arm chucking operations.

6. The improved cast power transmission disk of claim 1, said preselected chamfered areas being along the edges of the outer diameter of said hub and the internal diameter of said rim.

7. The improved cast power transmission disk of claim 1, said remaining minor portion of said disk being of sufficient size to allow said remaining minor portion to serve as a second chuckable portion so that said major portion of said cast disk can be machined at preselected locations.

8. The improved cast power transmission disk of claim 1, at least said major portion of said disk being provided with a reinforcing ring of cast material adjacent the outer extremities of said disk body to provide reinforcing strength and disk balance.

9. The improved cast power transmission disk of claim 1, said motion transmission unit comprising a set of gear teeth.

10. The improved cast power transmission disk of claim 1, said motion transmission unit comprising at least one belt receiving groove.

11. An improved cast gray iron metal sheave including a rim having at least one motion transmission unit to be machine finished in the form of a belt receiving groove therein, a centrally disposed shaft receiving tapered bored hub and an intermediate body in the form of spaced arms integrally disposed in radially extending spaced fashion between said rim and said shaft receiving hub comprising:

an integral sheave formed from a pair of mold sections having a substantially flat mold parting plane along one face of said radially extending spaced arms forming said intermediate body so that the entirety of said arms and major portions of said integral hub and said rim constituting a major portion of said sheave falls on one side of said mold parting plane and the remaining minor portions of said hub and said grooved rim constituting a minor portion of said sheaves fall on the opposite side of said parting plane with said major portion of said sheave on one side of said parting plane serving as a first chuckable portion for machine finishing said minor portion of said sheave at preselected locations and said minor portion of said sheave being sized to serve as a second chuckable portion for machine finishing said major portion of said sheave, said radially extending spaced arms having added reinforcing material at the base outer diameter of said hub to increase hub strength allowing reduced axial hub length and formed minimum drafting angles along the edges thereof to provide ready cast release and maximum arm area for arm chucking operations; and, with select edge areas of the major portion of said rim and hub being chamfered.

* * * * *